US011744322B2

(12) United States Patent
Hartmann et al.

(10) Patent No.: US 11,744,322 B2
(45) Date of Patent: Sep. 5, 2023

(54) SOLE OF A SHOE, PARTICULARLY AN ATHLETIC SHOE

(71) Applicants: PUMA SE, Herzogenaurach (DE); MASSACHUSETTS INSTITUTE OF TECHNOLOGY, Cambridge, MA (US)

(72) Inventors: Matthias Hartmann, Forchheim (DE); Reinhold Sussmann, Scheinfeld (DE); Federico Casalegno, San Francisco, CA (US); Hunmin Koh, Somerville, MA (US); Yihyun Lim, Somerville, MA (US); Yasaman Tahouni, Cambridge, MA (US); Will Walker, Oakland, CA (US)

(73) Assignees: PUMA SE, Herzogenaurach (DE); MASSACHUETTS INSTITUTE OF TECHNOLOGY, Cambridge, MA (US)

( * ) Notice: Subject to any disclaimer, the term of this patent is extended or adjusted under 35 U.S.C. 154(b) by 0 days.

(21) Appl. No.: 17/053,510

(22) PCT Filed: May 8, 2018

(86) PCT No.: PCT/EP2018/061934
§ 371 (c)(1),
(2) Date: Nov. 6, 2020

(87) PCT Pub. No.: WO2019/214814
PCT Pub. Date: Nov. 14, 2019

(65) Prior Publication Data
US 2021/0235813 A1 Aug. 5, 2021

(51) Int. Cl.
*A43B 13/18* (2006.01)
*A43B 13/12* (2006.01)

(52) U.S. Cl.
CPC ..... *A43B 13/181* (2013.01); *A43B 13/125* (2013.01); *A43B 13/187* (2013.01)

(58) Field of Classification Search
CPC ..... A43B 13/181; A43B 13/125; A43B 13/13187; A43B 13/206; A43B 13/14;
(Continued)

(56) References Cited

U.S. PATENT DOCUMENTS 2,983,056 A 5/1961 Murawski
3,469,576 A 9/1969 Smith
(Continued)

FOREIGN PATENT DOCUMENTS

CN 1285779 A 2/2001
CN 1334054 A 2/2002
(Continued)

OTHER PUBLICATIONS

US D748,382 S, 02/2016, Galway et al. (withdrawn)
(Continued)

*Primary Examiner* — Khoa D Huynh
*Assistant Examiner* — Haley A Smith
(74) *Attorney, Agent, or Firm* — Quarles & Brady LLP

(57) ABSTRACT

The invention relates to a sole (1) of a shoe, particularly of an athletic shoe, wherein the sole (1) has an extension in a longitudinal direction (L) and an extension in a vertical direction (V) perpendicular thereto, wherein a number of recesses (2) is introduced into the sole (1), wherein the recesses (2) extend in a transverse direction (Q) perpendicular to the longitudinal direction (L) and perpendicular to the vertical direction (V) and permeate the sole (1) at least in part. In order to influence the spring behaviour of the sole in a desired, specified manner, according to the invention, there is a first group of recesses (2') which, without external forces on the sole (1), are larger in the vertical direction (V) than
(Continued)

Figure 1:
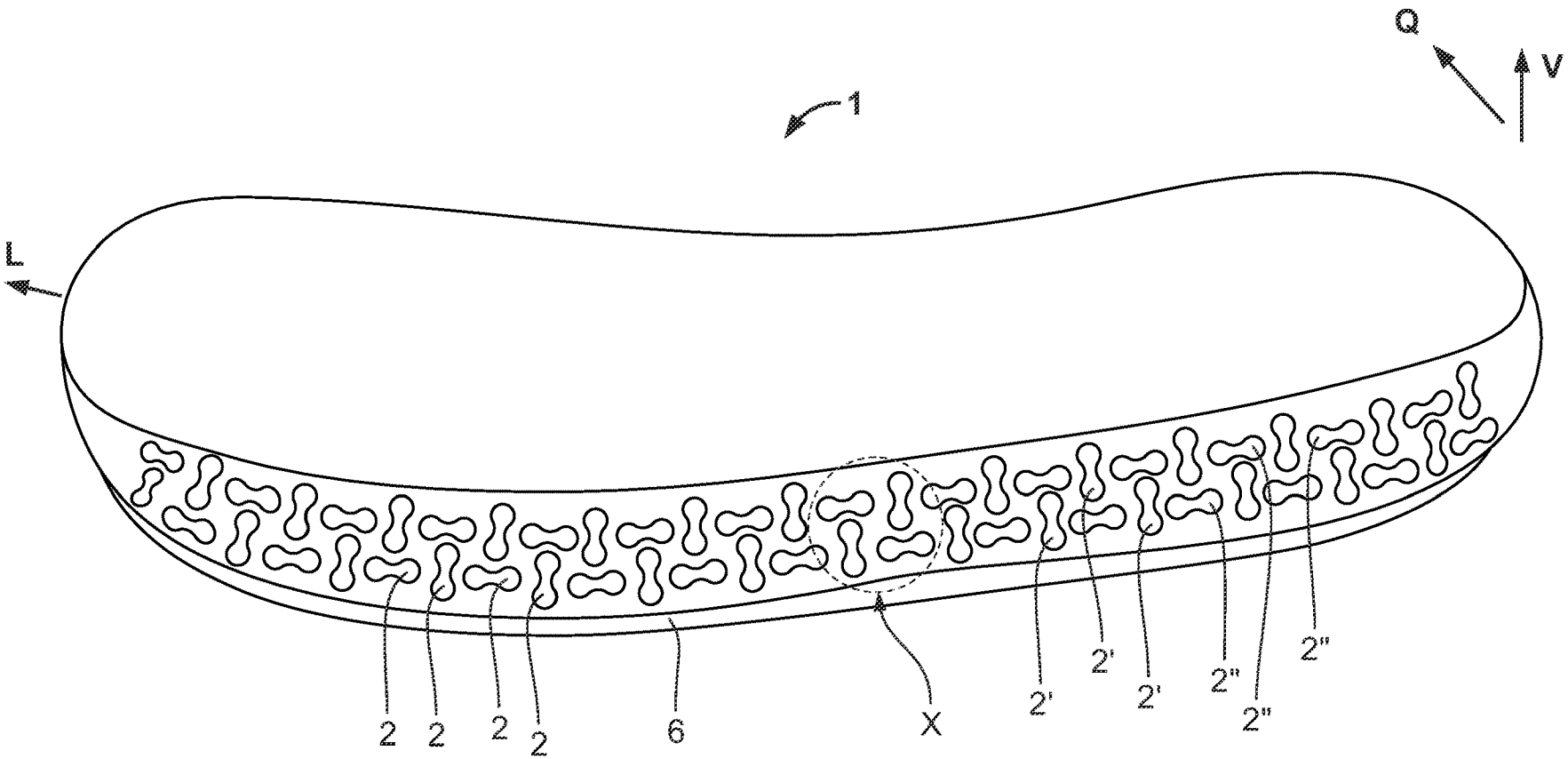

in the longitudinal direction (L), and that there is a second group of recesses (2") which, without external forces on the sole (1), are smaller in the vertical direction (V) than in the longitudinal direction (L), wherein at least in sections, at least one row (3, 4) of recesses (2', 2") is arranged adjacent to each other in the longitudinal direction (L), wherein a recess (2") of the second group is arranged between two recesses (2') of the first group.

22 Claims, 3 Drawing Sheets

(58) Field of Classification Search
CPC .... A43B 1/0009; A43B 3/0052; A43B 3/0057
See application file for complete search history.

(56) References Cited

U.S. PATENT DOCUMENTS 3,573,155 A 3/1971 Mitchell
3,629,051 A 12/1971 Mitchell
4,100,686 A 7/1978 Sgarlato et al.
4,112,599 A 9/1978 Krippelz
D256,067 S 7/1980 Hagg et al.
4,235,026 A * 11/1980 Plagenhoef ..... A43B 13/181 36/28
D265,017 S 6/1982 Vermonet
D272,963 S 3/1984 Muller et al.
4,779,359 A 10/1988 Famolare, Jr.
D298,582 S 11/1988 Caire
D304,520 S 11/1989 Clark
D307,971 S 5/1990 Maccano et al.
4,942,679 A 7/1990 Brandon et al.
4,944,099 A 7/1990 Davis
D311,989 S 11/1990 Parker et al.
5,042,176 A 8/1991 Rudy
5,084,987 A 2/1992 Flemming
D324,762 S 3/1992 Hatfield
5,134,790 A 8/1992 Woitschaetzke et al.
D329,528 S 9/1992 Hatfield
5,152,081 A 10/1992 Hallenbeck et al.
D330,629 S 11/1992 Bramani
5,197,206 A 3/1993 Shorten
5,197,207 A 3/1993 Shorten
D337,650 S 7/1993 Thomas, III et al.
D340,797 S 11/1993 Pallera et al.
5,313,717 A 5/1994 Allen et al.
5,329,705 A 7/1994 Grim et al.
D350,222 S 9/1994 Hase
5,378,223 A 1/1995 Grim et al.
5,383,290 A 1/1995 Grim
D356,438 S 3/1995 Opie et al.
D365,920 S 1/1996 Schneider
5,607,749 A 3/1997 Strumor
D386,589 S 11/1997 Cass
D389,991 S 2/1998 Elliott
D390,349 S 2/1998 Murai et al.
5,952,065 A 9/1999 Mitchell et al.
D414,920 S 10/1999 Cahill
D415,610 S 10/1999 Cahill
D415,876 S 11/1999 Cahill
5,979,078 A 11/1999 McLaughlin
D423,199 S 4/2000 Cahill
D429,874 S 8/2000 Gumbert
D431,346 S 10/2000 Birkenstock
D444,620 S 7/2001 Della Valle
D446,002 S 8/2001 Leong et al.
D460,852 S 7/2002 Daudier
6,467,197 B1 10/2002 Mitsui et al.
6,558,784 B1 5/2003 Norton et al.
6,618,959 B1 9/2003 Sussmann
6,647,646 B2 11/2003 Mitsui et al.
D483,932 S 12/2003 Cooper
6,670,029 B2 12/2003 Norton et al.
6,763,611 B1 7/2004 Fusco
6,763,615 B2 7/2004 Mitsui et al.
D494,343 S 8/2004 Morris
6,782,640 B2 8/2004 Westin
D496,149 S 9/2004 Belley et al.
6,817,113 B2 11/2004 Pan
6,843,000 B1 1/2005 Park
6,848,200 B1 2/2005 Westin
6,883,252 B2 4/2005 Cagner
6,920,707 B1 * 7/2005 Greene ..... A43B 13/16 36/97
6,951,066 B2 10/2005 Snow
6,957,504 B2 10/2005 Morris
D512,208 S 12/2005 Kubo et al.
D515,297 S 2/2006 Acheson
7,086,179 B2 8/2006 Dojan et al.
7,086,180 B2 8/2006 Dojan et al.
7,096,605 B1 8/2006 Kozo et al.
7,100,310 B2 9/2006 Foxen et al.
7,141,131 B2 11/2006 Foxen et al.
7,153,560 B2 12/2006 Hofmann
7,254,906 B2 8/2007 Morris et al.
D549,934 S 9/2007 Horne et al.
D551,831 S 10/2007 Romero-Sanchez
D556,982 S 12/2007 Harper et al.
D560,883 S 2/2008 McClaskie
D561,433 S 2/2008 McClaskie
D571,085 S 6/2008 McClaskie
7,401,420 B2 7/2008 Dojan et al.
D576,780 S 9/2008 Jolicoeur
D586,090 S 2/2009 Turner et al.
7,484,318 B2 2/2009 Finkelstein
D596,384 S 7/2009 Andersen et al.
7,555,848 B2 7/2009 Aveni et al.
7,556,846 B2 7/2009 Dojan et al.
7,559,107 B2 7/2009 Dojan et al.
7,562,469 B2 7/2009 Dojan
D597,293 S 8/2009 Banik et al.
D601,333 S 10/2009 McClaskie
7,665,230 B2 2/2010 Dojan et al.
7,676,955 B2 3/2010 Dojan et al.
7,676,956 B2 3/2010 Dojan et al.
7,685,741 B2 3/2010 Friedman
D616,183 S 5/2010 Skaja
D617,540 S 6/2010 McClaskie
D624,291 S 9/2010 Henderson
7,805,859 B2 10/2010 Finkelstein
D631,237 S 1/2011 Genuin et al.
D631,646 S 2/2011 Muller
D633,286 S 3/2011 Skaja
D633,287 S 3/2011 Skaja
D636,571 S 4/2011 Avar
8,074,377 B2 12/2011 Nishiwaki et al.
8,112,909 B2 2/2012 Kubo et al.
8,122,614 B2 2/2012 Sussmann
8,176,657 B2 * 5/2012 Schinlder ..... A43B 13/206 36/35 R
8,296,969 B2 10/2012 Granger et al.
D671,305 S 11/2012 Escobar
D671,306 S 11/2012 Tzenos
8,312,644 B2 11/2012 Peikert et al.
8,321,984 B2 12/2012 Dojan et al.
8,356,429 B2 1/2013 Eder et al.
8,418,379 B2 4/2013 Nishiwaki et al.
8,429,835 B2 4/2013 Dojan et al.
D693,553 S 11/2013 McClaskie
8,572,866 B2 11/2013 Dojan et al.
8,578,535 B2 11/2013 Dojan et al.
D696,501 S 12/2013 Miner
D696,502 S 12/2013 Miner
D696,503 S 12/2013 Miner
8,657,979 B2 2/2014 Dojan et al.
8,671,591 B2 3/2014 Brown
8,745,892 B2 6/2014 Polegato Moretti
D709,680 S 7/2014 Herath
8,789,298 B2 7/2014 Eder et al.
D711,081 S 8/2014 Miner
D713,623 S 9/2014 Lo
8,961,844 B2 2/2015 Baghdadi et al.

(56) References Cited

U.S. PATENT DOCUMENTS

D731,763 S 6/2015 Solstad
D734,600 S 7/2015 Gargiulo
9,078,493 B2 7/2015 Bradford
D739,131 S 9/2015 Del Biondi
9,125,454 B2 9/2015 De Roode et al.
D740,003 S 10/2015 Herath
D740,004 S 10/2015 Hoellmueller et al.
D746,559 S 1/2016 Besanceney et al.
9,241,536 B2 1/2016 Smaldone et al.
D753,381 S 4/2016 Ostapenko
D756,085 S 5/2016 Spring
D756,620 S 5/2016 Boys
9,351,534 B2 5/2016 Peikert et al.
D758,056 S 6/2016 Galway et al.
D759,358 S 6/2016 Cullen
9,402,439 B2 8/2016 Cross et al.
D765,361 S 9/2016 Johnsongriffin
D765,362 S 9/2016 Kuerbis
D767,263 S 9/2016 Reiser
9,456,656 B2 10/2016 Cross
9,486,036 B1 11/2016 Douglas
D773,161 S 12/2016 Teteriatnikov
D773,790 S 12/2016 Raysse
D773,791 S 12/2016 Raysse
9,510,640 B2 12/2016 Bier et al.
D776,410 S 1/2017 Galway et al.
9,538,811 B2 1/2017 Cross
9,549,590 B2 1/2017 Cross et al.
9,554,620 B2 1/2017 Cross et al.
9,554,622 B2 1/2017 Cross
9,554,624 B2 1/2017 Cross
9,572,404 B2 2/2017 Dojan et al.
D781,543 S 3/2017 Raysse
9,585,435 B2 3/2017 Bier et al.
D783,247 S 4/2017 McMillan
9,610,746 B2 4/2017 Wardlaw et al.
9,682,522 B2 6/2017 Baghdadi et al.
9,687,041 B2 6/2017 Peikert et al.
D790,817 S 7/2017 Perkins et al.
D791,452 S 7/2017 Dombrow
D792,067 S 7/2017 Raysse
D793,680 S 8/2017 Lee
D793,688 S 8/2017 Avar et al.
D794,289 S 8/2017 Kanata
9,717,301 B2 8/2017 Peikert et al.
9,723,895 B2 8/2017 Schaefer et al.
D797,418 S 9/2017 Lee et al.
D798,553 S 10/2017 Lee
D799,183 S 10/2017 Weeks
9,775,769 B2 10/2017 Brown et al.
9,781,970 B2 10/2017 Wardlaw et al.
9,781,974 B2 10/2017 Reinhardt et al.
9,788,598 B2 10/2017 Reinhardt et al.
9,788,606 B2 10/2017 Reinhardt et al.
9,795,186 B2 10/2017 Reinhardt et al.
9,820,528 B2 11/2017 Reinhardt et al.
9,820,532 B2 11/2017 Cross et al.
9,849,645 B2 12/2017 Wardlaw et al.
D808,143 S 1/2018 Negri
9,854,869 B2 1/2018 Nordstrom
9,861,159 B2 * 1/2018 Kohatsu ..... A43D 119/00
D809,755 S 2/2018 Stavseng et al.
D809,756 S 2/2018 Stavseng et al.
D809,761 S 2/2018 Parrett
D810,407 S 2/2018 DeAlmeida
D811,062 S 2/2018 Teague
9,884,947 B2 2/2018 Prissok et al.
D813,508 S 3/2018 Weeks
9,926,423 B2 3/2018 Baghdadi
D814,752 S 4/2018 Ormsby
9,930,928 B2 4/2018 Whiteman et al.
9,961,961 B2 5/2018 Smith
9,968,157 B2 5/2018 Wardlaw et al.
9,968,160 B2 5/2018 Peyton
10,039,342 B2 8/2018 Reinhardt et al.
10,051,914 B2 8/2018 Cross et al.
10,051,917 B2 8/2018 Dojan et al.
D828,686 S 9/2018 Hoellmueller et al.
D831,315 S 10/2018 Mahoney
D831,317 S 10/2018 Jenkins et al.
10,098,411 B2 10/2018 Hoffer et al.
10,098,412 B2 10/2018 Hoffer et al.
10,111,494 B2 10/2018 Cross
D836,893 S 1/2019 Bischoff et al.
10,182,612 B2 1/2019 Bunnell et al.
D840,135 S 2/2019 Dombrow
D840,136 S 2/2019 Herath et al.
D840,137 S 2/2019 Herath et al.
10,226,099 B2 3/2019 Bischoff
10,227,467 B2 3/2019 Baghdadi
D846,255 S 4/2019 Khalife
D846,256 S 4/2019 Khalife
10,259,183 B2 4/2019 Wardlaw et al.
10,271,615 B2 4/2019 Cross
D847,475 S 5/2019 Khalife
D847,480 S 5/2019 Khalife
10,278,448 B2 5/2019 Cross
10,285,471 B2 5/2019 Cross
D850,766 S 6/2019 Girard et al.
D851,889 S 6/2019 Dobson et al.
D852,475 S 7/2019 Hoellmueller
D852,476 S 7/2019 Hartmann
D853,691 S 7/2019 Coonrod et al.
D853,699 S 7/2019 Coonrod et al.
10,433,616 B2 10/2019 Takeshita et al.
10,470,521 B2 11/2019 Iuchi et al.
10,645,998 B2 5/2020 Shaffer et al.
10,786,039 B2 * 9/2020 Kohatsu ..... A43D 1/02
11,076,656 B2 8/2021 Kormann et al.
2002/0071946 A1 6/2002 Norton et al.
2003/0097767 A1 5/2003 Perkinson
2003/0208925 A1 11/2003 Pan
2004/0148805 A1 8/2004 Morris
2004/0154189 A1 * 8/2004 Wang ..... A43B 13/187 36/28
2006/0026863 A1 2/2006 Liu
2006/0234012 A1 * 10/2006 Wang ..... A43B 1/0009 428/188
2008/0127513 A1 * 6/2008 Schinlder ..... A43B 13/206 36/25 R
2008/0148599 A1 6/2008 Collins
2009/0064542 A1 * 3/2009 Figueroa ..... A43B 13/187 36/7.4
2009/0172971 A1 7/2009 Peikert et al.
2010/0242309 A1 9/2010 McCann
2011/0047720 A1 3/2011 Maranan et al.
2011/0197468 A1 8/2011 Kubo et al.
2011/0252670 A1 10/2011 Smith
2013/0055599 A1 3/2013 Peikert et al.
2013/0059116 A1 3/2013 Peikert et al.
2013/0145653 A1 6/2013 Bradford
2013/0160223 A1 6/2013 Bier et al.
2013/0233477 A1 9/2013 Bier et al.
2013/0291409 A1 11/2013 Reinhardt et al.
2013/0312284 A1 11/2013 Berend et al.
2014/0033574 A1 * 2/2014 Wan ..... A43B 19/005 36/103
2014/0086504 A1 3/2014 Arai
2014/0151918 A1 6/2014 Hartmann
2014/0196308 A1 7/2014 Baratta et al.
2014/0208610 A1 7/2014 Dirsa et al.
2014/0223776 A1 8/2014 Wardlaw et al.
2014/0223777 A1 8/2014 Whiteman et al.
2015/0096203 A1 4/2015 Brown et al.
2015/0272272 A1 * 10/2015 Scofield ..... A43B 1/0009 36/28
2016/0007676 A1 1/2016 Leimer et al.
2016/0025343 A1 1/2016 Bertoldi
2016/0037859 A1 2/2016 Smith et al.
2016/0044992 A1 2/2016 Reinhardt et al.
2016/0120260 A1 5/2016 Hansen et al.
2016/0227876 A1 8/2016 Le et al.
2016/0242502 A1 8/2016 Spanks
2016/0278481 A1 9/2016 Le et al.

(56) References Cited

U.S. PATENT DOCUMENTS

| | | | |
|---|---|---|---|
| 2016/0295955 | A1 | 10/2016 | Wardlaw et al. |
| 2016/0324260 | A1 | 11/2016 | Guyan |
| 2016/0345665 | A1* | 12/2016 | Kohatsu ..... A43D 1/02 |
| 2016/0374428 | A1 | 12/2016 | Kormann et al. |
| 2017/0006958 | A1 | 1/2017 | Jeong |
| 2017/0105478 | A1 | 4/2017 | Cross et al. |
| 2017/0172251 | A1 | 6/2017 | Douglas |
| 2017/0245581 | A1 | 8/2017 | McFarland et al. |
| 2017/0245582 | A1 | 8/2017 | Green et al. |
| 2017/0253710 | A1 | 9/2017 | Smith et al. |
| 2017/0258178 | A1 | 9/2017 | Cross et al. |
| 2017/0258180 | A1 | 9/2017 | Cross et al. |
| 2017/0259474 | A1 | 9/2017 | Holmes et al. |
| 2017/0341325 | A1 | 11/2017 | Le et al. |
| 2017/0354568 | A1 | 12/2017 | Brown et al. |
| 2018/0000197 | A1 | 1/2018 | Wardlaw et al. |
| 2018/0027922 | A1 | 2/2018 | Orand |
| 2018/0035755 | A1 | 2/2018 | Reinhardt et al. |
| 2018/0049509 | A1 | 2/2018 | Zwick et al. |
| 2018/0064210 | A1 | 3/2018 | Turner et al. |
| 2018/0077997 | A1 | 3/2018 | Hoffer et al. |
| 2018/0077998 | A1 | 3/2018 | Nordstrom |
| 2018/0092432 | A1 | 4/2018 | Hoffer et al. |
| 2018/0098602 | A1 | 4/2018 | Kohatsu et al. |
| 2018/0100049 | A1 | 4/2018 | Prissok et al. |
| 2018/0103719 | A1 | 4/2018 | Chen |
| 2018/0103725 | A1 | 4/2018 | Chen |
| 2018/0110292 | A1 | 4/2018 | Beers et al. |
| 2018/0116327 | A9 | 5/2018 | McFarland et al. |
| 2018/0125156 | A1 | 5/2018 | Bray, Jr. |
| 2018/0125157 | A1 | 5/2018 | Bray, Jr. |
| 2018/0132487 | A1 | 5/2018 | Kormann et al. |
| 2018/0153264 | A1 | 6/2018 | Amos et al. |
| 2018/0154598 | A1 | 6/2018 | Kurtz et al. |
| 2018/0199667 | A1 | 7/2018 | Wang |
| 2018/0206591 | A1 | 7/2018 | Whiteman et al. |
| 2018/0206599 | A1 | 7/2018 | Amos et al. |
| 2018/0235310 | A1 | 8/2018 | Wardlaw et al. |
| 2018/0289108 | A1 | 10/2018 | Hoffer et al. |
| 2018/0289109 | A1 | 10/2018 | Beers et al. |
| 2018/0303198 | A1 | 10/2018 | Reinhardt et al. |
| 2018/0325217 | A1 | 11/2018 | Dojan et al. |
| 2018/0338569 | A1 | 11/2018 | Cross et al. |
| 2018/0352900 | A1 | 12/2018 | Hartmann et al. |
| 2019/0082782 | A1 | 3/2019 | Bunnell et al. |
| 2019/0126580 | A1 | 5/2019 | Paulson et al. |
| 2019/0133251 | A1 | 5/2019 | Hartmann et al. |
| 2019/0150564 | A1 | 5/2019 | Bischoff |
| 2019/0216167 | A1 | 7/2019 | Hoffer et al. |
| 2019/0216168 | A1 | 7/2019 | Hoffer et al. |
| 2019/0223539 | A1 | 7/2019 | Hoffer et al. |
| 2019/0223550 | A1 | 7/2019 | Levy |
| 2019/0223551 | A1 | 7/2019 | Hoffer et al. |
| 2019/0281921 | A1 | 9/2019 | Bray, Jr. |
| 2019/0291371 | A1 | 9/2019 | Wardlaw et al. |

FOREIGN PATENT DOCUMENTS

| | | | |
|---|---|---|---|
| CN | 1653982 | A | 8/2005 |
| CN | 2790218 | Y | 6/2006 |
| CN | 101299941 | A | 11/2008 |
| CN | 201226862 | Y | 4/2009 |
| CN | 101537675 | A | 9/2009 |
| CN | 201813947 | U | 5/2011 |
| CN | 102273769 | A | 12/2011 |
| CN | 102481746 | A | 5/2012 |
| CN | 104256997 | A | 1/2015 |
| CN | 105025745 | A | 11/2015 |
| CN | 105476176 | A | 4/2016 |
| CN | 105595519 | A | 5/2016 |
| CN | 106939097 | A | 7/2017 |
| CN | 107048591 | A | 8/2017 |
| CN | 206808782 | U | 12/2017 |
| DE | 3440206 | A1 | 5/1985 |
| DE | 202005017043 | U1 | 3/2007 |
| DM | 102274 | | 8/2018 |
| DM | 103418 | | 9/2018 |
| EM | 001286116-0005 | | 7/2011 |
| EM | 002219956-0024 | | 5/2013 |
| EM | 002772764-0015 | | 2/2016 |
| EM | 003165984-0005 | | 6/2016 |
| EM | 003039619-0034 | | 7/2016 |
| EM | 003315555-0001 | | 8/2016 |
| EM | 003316389-0001 | | 8/2016 |
| EM | 003330174-0003 | | 8/2016 |
| EM | 003344076-0002 | | 9/2016 |
| EM | 003362672-0001 | | 9/2016 |
| EM | 003718311-0019 | | 2/2017 |
| EM | 003761089-0028 | | 5/2017 |
| EM | 004363935-0008 | | 10/2017 |
| EM | 004386571-0002 | | 10/2017 |
| EM | 004366326-0001 | | 11/2017 |
| EM | 003761113-0025 | | 12/2017 |
| EM | 004675411-0006 | | 1/2018 |
| EM | 004543882-0008 | | 5/2018 |
| EM | 005243227-0002 | | 5/2018 |
| EM | 005260023-0003 | | 5/2018 |
| EM | 005278413-0002 | | 5/2018 |
| EM | 005320371-0002 | | 7/2018 |
| EM | 005841939-0004 | | 12/2018 |
| EM | 003649060-0005 | | 1/2019 |
| EM | 004352755-0004 | | 1/2019 |
| EM | 005612025-0001 | | 1/2019 |
| EM | 004812501-0004 | | 2/2019 |
| EM | 005191004-0010 | | 2/2019 |
| EM | 006335345-0003 | | 4/2019 |
| EM | 003522580-0029 | | 6/2019 |
| EM | 003649540-0001 | | 7/2019 |
| EP | 1021965 | A2 | 7/2000 |
| EP | 1164884 | A1 | 1/2002 |
| EP | 1033924 | B1 | 9/2003 |
| EP | 1563750 | A1 | 8/2005 |
| EP | 1991078 | A1 | 11/2008 |
| EP | 2103420 | A2 | 9/2009 |
| EP | 1979401 | B1 | 9/2010 |
| EP | 2490561 | A1 | 8/2012 |
| EP | 1991728 | B1 | 1/2013 |
| EP | 2611323 | A1 | 7/2013 |
| EP | 2490564 | B1 | 1/2014 |
| EP | 2786670 | A1 | 10/2014 |
| EP | 2724635 | B1 | 3/2015 |
| EP | 1796493 | B1 | 4/2015 |
| EP | 2676562 | B1 | 4/2015 |
| EP | 2611321 | B1 | 8/2015 |
| EP | 2984956 | A1 | 2/2016 |
| EP | 3001922 | A1 | 4/2016 |
| EP | 3001923 | A1 | 4/2016 |
| EP | 3027377 | A1 | 6/2016 |
| EP | 3041892 | A1 | 7/2016 |
| EP | 2197311 | B1 | 8/2016 |
| EP | 2649896 | B1 | 10/2016 |
| EP | 3078287 | A1 | 10/2016 |
| EP | 3114954 | A1 | 1/2017 |
| EP | 3114955 | A1 | 1/2017 |
| EP | 3114956 | A1 | 1/2017 |
| EP | 3114959 | A1 | 1/2017 |
| EP | 2713794 | B1 | 4/2017 |
| EP | 3186306 | A1 | 7/2017 |
| EP | 3200640 | A1 | 8/2017 |
| EP | 2467037 | B1 | 10/2017 |
| EP | 2872309 | B1 | 11/2017 |
| EP | 3267818 | A1 | 1/2018 |
| EP | 3267820 | A1 | 1/2018 |
| EP | 3267822 | A1 | 1/2018 |
| EP | 3267823 | A1 | 1/2018 |
| EP | 3267824 | A2 | 1/2018 |
| EP | 3267826 | A1 | 1/2018 |
| EP | 2910141 | B1 | 2/2018 |
| EP | 3289907 | A1 | 3/2018 |
| EP | 3302143 | A1 | 4/2018 |
| EP | 3308663 | A1 | 4/2018 |
| EP | 3318150 | A1 | 5/2018 |
| EP | 3338581 | A1 | 6/2018 |
| EP | 3346862 | A1 | 7/2018 |

(56) References Cited

FOREIGN PATENT DOCUMENTS

| | | | |
|---|---|---|---|
| EP | 2845504 | B1 | 8/2018 |
| EP | 3352607 | A1 | 8/2018 |
| EP | 3352608 | A1 | 8/2018 |
| EP | 3352610 | A1 | 8/2018 |
| EP | 3352611 | A1 | 8/2018 |
| EP | 3352612 | A1 | 8/2018 |
| EP | 3352615 | A1 | 8/2018 |
| EP | 3338984 | A3 | 9/2018 |
| EP | 2948012 | B1 | 10/2018 |
| EP | 3381311 | A1 | 10/2018 |
| EP | 3391767 | A1 | 10/2018 |
| EP | 3412164 | A1 | 12/2018 |
| EP | 3416516 | A1 | 12/2018 |
| EP | 2611322 | B1 | 1/2019 |
| EP | 3423621 | A1 | 1/2019 |
| EP | 3434128 | A1 | 1/2019 |
| EP | 3010362 | B1 | 4/2019 |
| EP | 3466291 | A1 | 4/2019 |
| EP | 3248770 | B1 | 5/2019 |
| EP | 3348160 | B1 | 5/2019 |
| EP | 3476237 | A1 | 5/2019 |
| EP | 3484320 | A1 | 5/2019 |
| EP | 3284362 | B1 | 7/2019 |
| EP | 3386334 | B1 | 7/2019 |
| EP | 3534743 | A1 | 9/2019 |
| GB | 350493 | A | 6/1931 |
| JP | 2002526126 | A | 8/2002 |
| JP | 2010158511 | A | 7/2010 |
| JP | 5465814 | B1 | 4/2014 |
| JP | 2016202903 | A | 12/2016 |
| KR | 101567716 | B1 | 11/2015 |
| WO | 2006112622 | A1 | 10/2006 |
| WO | 2010021517 | A2 | 2/2010 |
| WO | 2010084367 | A1 | 7/2010 |
| WO | 2015017088 | A1 | 2/2015 |
| WO | 2000051458 | A1 | 11/2015 |
| WO | 2016030026 | A1 | 3/2016 |
| WO | 2016030333 | A1 | 3/2016 |
| WO | 2016053443 | A1 | 4/2016 |
| WO | 2016144406 | A1 | 9/2016 |
| WO | 2016144407 | A1 | 9/2016 |
| WO | 2016144408 | A1 | 9/2016 |
| WO | 2016144409 | A1 | 9/2016 |
| WO | 2016144410 | A1 | 9/2016 |
| WO | 2016144413 | A1 | 9/2016 |
| WO | 2016191109 | A1 | 12/2016 |
| WO | 2017042127 | A1 | 3/2017 |
| WO | 2017053650 | A1 | 3/2017 |
| WO | 2017053654 | A1 | 3/2017 |
| WO | 2017053658 | A1 | 3/2017 |
| WO | 2017053665 | A1 | 3/2017 |
| WO | 2017053669 | A1 | 3/2017 |
| WO | 2017053674 | A1 | 3/2017 |
| WO | 2017097315 | A1 | 6/2017 |
| WO | 2017142857 | A1 | 8/2017 |
| WO | 2017151496 | A1 | 9/2017 |
| WO | 2018011030 | A1 | 1/2018 |
| WO | 2018083676 | A1 | 5/2018 |
| WO | 2018099833 | A1 | 6/2018 |
| WO | 2018103811 | A1 | 6/2018 |
| WO | 2018169535 | A1 | 9/2018 |
| WO | 2018169537 | A1 | 9/2018 |
| WO | 2018192262 | A1 | 10/2018 |
| WO | 2019029781 | A1 | 2/2019 |
| WO | 2019073607 | A1 | 4/2019 |
| WO | 2019101339 | A1 | 5/2019 |
| WO | 2019150492 | A1 | 8/2019 |

OTHER PUBLICATIONS

First Office Action from related Chinese Patent Application No. 201880093277_X dated Nov. 26, 2021 (14 pages) including English translation.

Office Action from related Japanese Patent Application No. 2020-562609 dated Dec. 21, 2021 (11 pages) including English translation.

International Search Report of International Application No. PCT/EP2018/061935, dated Jan. 18, 2019, 7 pages (with English translation).

Written Opinion of International Application No. PCT/EP2018/061935, dated Jan. 18, 2019, 6 pages (English translation unavailable).

International Preliminary Report on Patentability (Form IPEA/409) of International Application No. PCT/EP2018/061935, dated Jul. 6, 2020, 20 pages (English translation unavailable).

Bicycling Catalog 39—Giant Phase 2 Road Shoe [online] <https://www.camdenbikes.com/product/giant-phase-2-road-shoe-243911-1.htm> Accessed Date: Jul. 16, 2019 (3 pages).

Bicycling Catalog 39—Line MES composite sole off-road shoe [online]: <https://www.berkshirebikeandboard.com/product/giant-line-mes-composite-sole-off-road-shoe-341091-1.htm> Accessed Date: Jul. 16, 2019 (4 pages).

Hot pressing film TPU film for bonding synthetic leather and mesh fabric together on shoes upper [online] <https://www.alibaba.com/product-detail/hot-pressing-film-TPU-film-for_60164856956.html> Accessed Date: Jul. 16, 2019 (5 pages).

International Search Report of International Application No. PCT/EP2018/061934 dated Jan. 17, 2019, 6 pages.

Written Opinion of International Application No. PCT/EP2018/061934 dated Jan. 17, 2019, 7 pages.

International Preliminary Report on Patentability (Form IPEA/409) of International Application No. PCT/EP2018/061934, dated Jan. 3, 2020, 24 pages.

* cited by examiner

SOLE OF A SHOE, PARTICULARLY AN ATHLETIC SHOE

This application is a U.S. National Stage application, filed pursuant to 35 U.S.C. § 371, of international application no. PCT/EP2018/061934, filed on May 8, 2018, the contents of which is incorporated herein by reference in its entirety.

The invention relates to a sole of a shoe, particularly of an athletic shoe, wherein the sole has an extension in a longitudinal direction and an extension in a vertical direction perpendicular thereto, wherein a number of recesses is introduced into the sole, wherein the recesses extend in a transverse direction perpendicular to the longitudinal direction and perpendicular to the vertical direction and permeate the sole at least in part.

In the case of sports shoes, an attempt is made to give the sole a certain and desired spring behaviour by means of the geometric design of the sole. This means that the sole exhibits a desired deformation behaviour in the vertical direction when subjected to the weight of the wearer of the shoe, in particular a certain characteristic curve between the force applied and the strain in the vertical direction.

A sole of the type mentioned above is known from U.S. Pat. No. 2,983,056 A. The body of the sole is provided here in transverse direction with a plurality of recesses, which are formed circularly, laterally on the sole, thus seen in transverse direction. The recesses have different diameters, whereby one with a smaller diameter is located between two recesses with a larger diameter. Such recesses can be used to influence the spring or damping behaviour of the sole.

The invention is based on the object to further develop a shoe sole of the type mentioned above in such a way that it becomes possible to influence the spring and damping behaviour of the sole in a desired, predetermined improved manner.

The solution of this object by the invention is characterized in that there is a first group of recesses which (without external forces on the sole) are larger in the vertical direction than in the longitudinal direction, and that there is a second group of recesses which (without external forces on the sole) are smaller in the vertical direction than in the longitudinal direction, wherein at least in sections, at least one row of recesses is arranged adjacent to each other in the longitudinal direction, wherein a recess of the second group is arranged between two recesses of the first group.

At least in sections an upper row of recesses and a lower row of recesses can thereby be arranged above one another in the vertical direction. The two rows are in this case preferably arranged relative to each other in such a way that a recess of the first group lies vertically above a recess of the second group.

The recesses penetrate preferably at least partially the sole completely in the transverse direction.

The recesses extend thereby preferably along a straight line, they are thus designed straight and linear respectively.

Without external forces on the sole, preferably the largest dimension of a recess in a first direction is thereby at least 150%, preferably at least 180%, of the largest dimension of the recess in a second direction perpendicular to the first direction. Thereby, it is specifically preferred that the recesses, seen in the transverse direction, have a peripheral contour which has the shape of an eight. The recess has in this case in a central region preferably a restriction with a minimum extension which is at most 90%, preferably at most 80%, of the largest dimension in the second direction.

The largest dimension is thereby preferably between 8 mm and 18 mm, specifically preferred between 10 mm and 15 mm.

The wall thickness of the material of the sole remaining between the recesses is preferably substantially constant at least in sections. Insofar, it is preferred that the wall thickness at least in sections is in a range between 80% and 120% of an average value of the wall thickness (the average value of the wall thickness is the arithmetic mean, which is determined for the respective wall thicknesses between adjacent recesses over a given defined area of the lateral surface of the sole).

The sole consists preferably of polyurethane material, thermoplastic polyurethane (TPU) or thermoplastic elastomer (TPE) or comprises at least this material. The material of the sole is thereby preferably foamed.

The material of the sole has preferably a density between 0.20 and 0.50 g/cm$^3$. It has preferably a hardness between 30 and 50 Asker C.

The sole can be designed as a midsole. Thereby, it is possible that an outer sole is placed below the midsole.

The recesses are preferably arranged in the longitudinal direction over at least 33% of the total longitudinal extension of the sole. They are preferably arranged at least in a midfoot region and a rearfoot region of the sole.

The proposed design of the sole makes it possible to influence the control of the spring and cushioning properties or the hardness of the sole in a simple way. By the design of the recesses it is possible to realize a desired spring deflection when the sole is loaded with the weight of the wearer of the shoe equipped with the sole.

The present invention is based on the use of so-called "Mechanical Meta Material", in which it is intended that various rows of openings (known are mainly round or oval recesses in cross-section) of different sizes are or are to be introduced into the sole in order to achieve a certain spring or cushioning behaviour of the sole. This enables "Engineered Damping", in which the spring or damping properties obey a desired characteristic curve.

When a deformation force—caused by the weight of the wearer of the shoe—is applied, the resulting cells collapse in a special way so that special spring or damping characteristics can be realized.

In this respect, a "programmable folding or collapsing" of the sole structure is achieved, so to speak, since the structure itself forms a coherent system and the individual material sections are interdependent.

The advantages of the proposed structure can lead to a "negative stiffness", i.e. if the sole is slightly compressed in a vertical direction, the sole collapses in a defined way. It is also possible to structure the sole in the way described above in such a way that it has a sufficient degree of elasticity on the one hand and absorbs deformation energy as a result of a deformation force on the other.

In the drawings an embodiment of the invention is shown.

Figure 2:
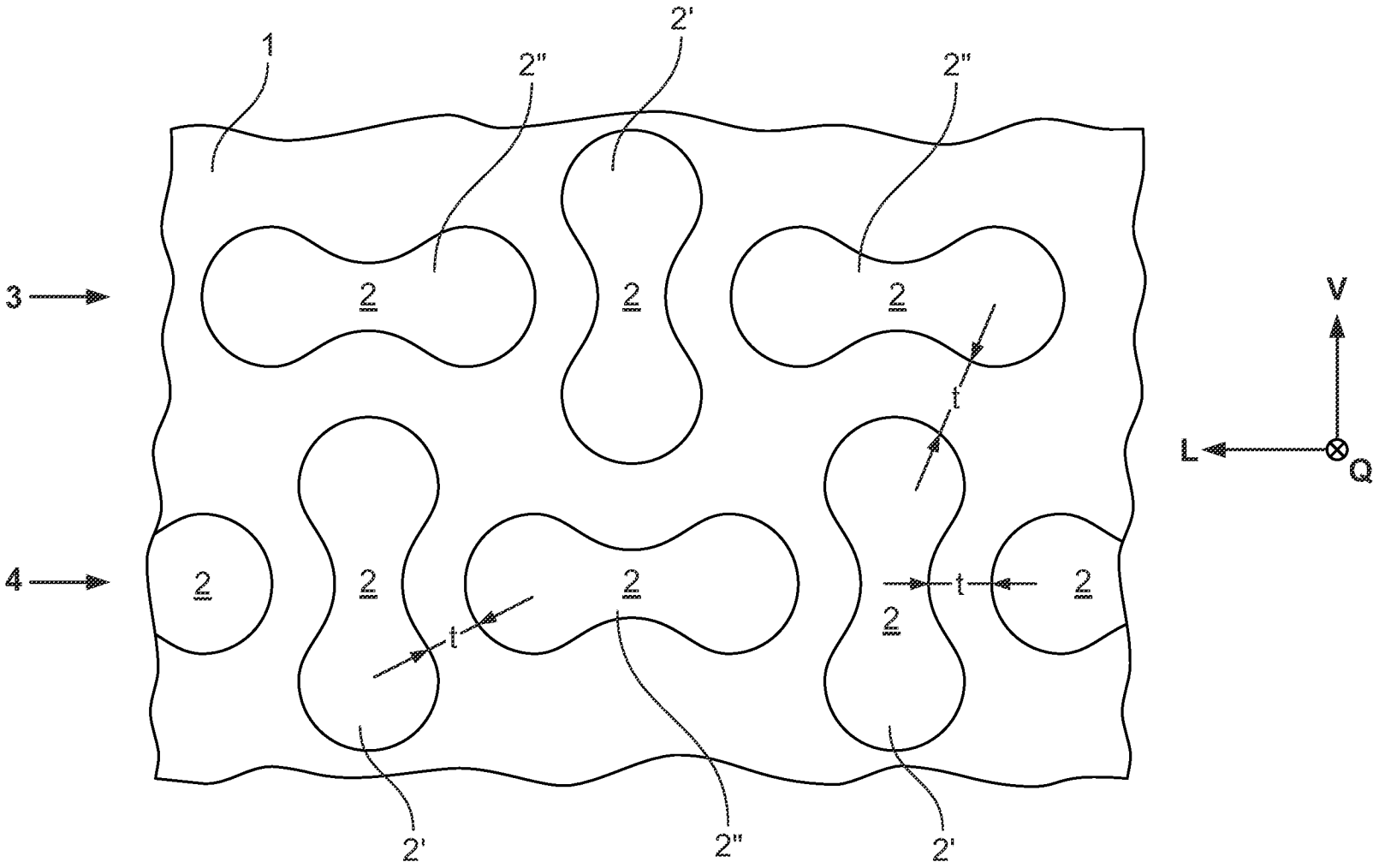
Figure 3:
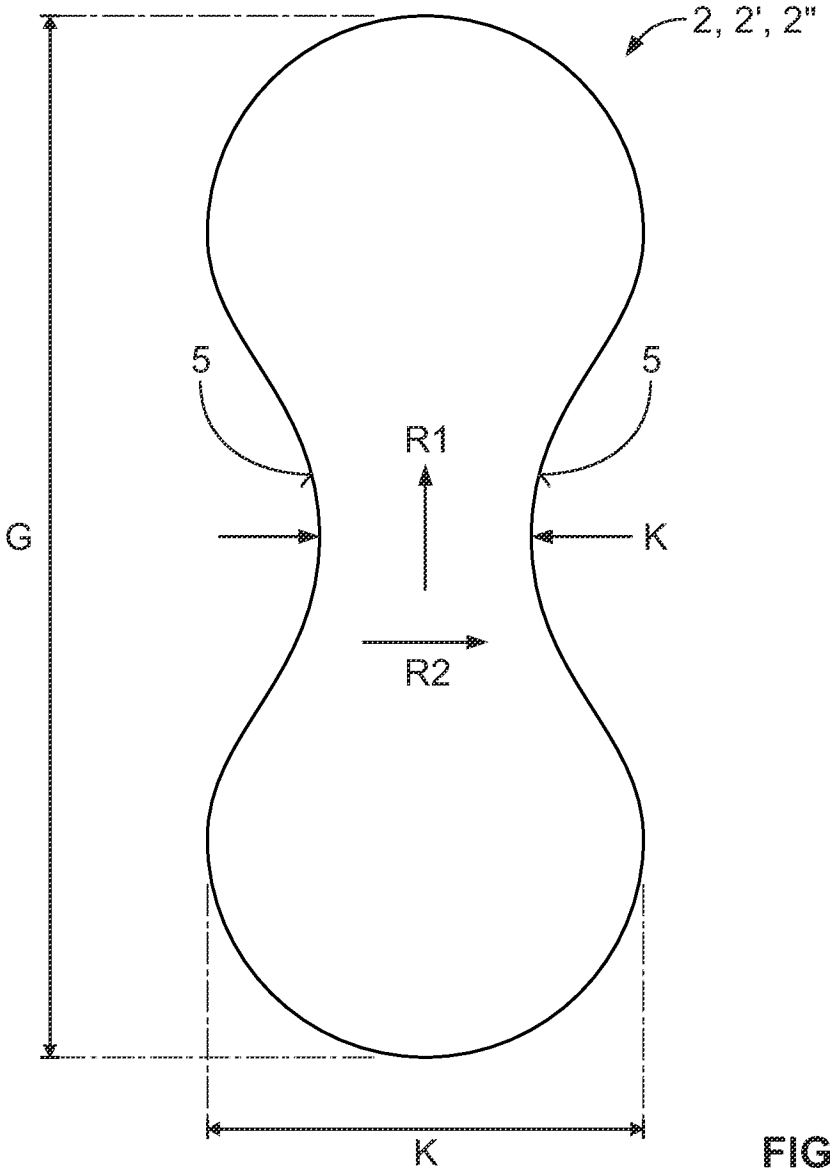

FIG. 1 shows a sole of a sports shoe, wherein said sole comprises a midsole and an outsole, FIG. 2 shows the section "X" according to FIG. 1 in more detail, seen in a transverse direction perpendicular to the longitudinal direction of the sole and perpendicular to the vertical direction, and FIG. 3 shows a recess in the sole with details of its geometry.

FIG. 1 shows a sole 1, which extends in a longitudinal direction L (corresponding to the longitudinal axis of the shoe with the sole) and in a vertical direction V (the vertical direction V indicates the direction when the shoe or the sole is standing on the ground when used as intended). Furthermore, sole 1 extends in a transverse direction Q, which is perpendicular to both the longitudinal direction L and the vertical direction V.

Sole 1 is here designed as a midsole, to the upper side of which the (not shown) shoe upper is attached in the known manner. An outer sole 6 is attached to the bottom of the sole.

Recesses 2 are incorporated into the sole 1. Preferably, these recesses extend in transverse direction Q over the entire width of the sole 1. Details on the design and arrangement of recesses 2 are shown in FIGS. 2 and 3. For this purpose, FIG. 2 shows the detail "X" according to FIG. 1 and FIG. 3 shows the geometrical design of a preferred design of a single recess 2.

As can be seen in FIG. 2 in combination with FIG. 1, two rows 3 and 4 of recesses 2 are incorporated into the sole 1. Thereby, two groups of recesses 2 are employed:

A first group of recesses 2' is designed in such a way that—without external forces on the sole 1—the recesses 2' are larger in vertical direction V than in longitudinal direction L. Then there is a second group of recesses 2", which—again without external forces on the sole 1—are smaller in vertical direction V than in longitudinal direction L. As can be seen in FIG. 2, in each row 3, 4 in longitudinal direction L the recesses 2', 2" are arranged next to each other in such a way that between two recesses 2' of the first group a recess 2" of the second group is arranged.

The individual recesses 2', 2" are each designed in such a way that they have the shape of an "eight" when viewed in transverse direction Q. Reference is made in particular to FIG. 3.

Accordingly, each recess 2', 2" has in a first direction R1 a largest dimension G (which is preferably between 10 mm and 15 mm); in a second direction R2, which is perpendicular to the first direction R1, the largest dimension of recess 2', 2" is denoted with K. The dimension G is preferably at least 150% (particularly preferably even at least 180%) of the dimension K.

In the central area along the extension in the first direction R1, the recess 2', 2" has a restriction 5 (which results in the shape of an "eight"), so that the recess 2', 2" has a minimal extension k here. This minimum extension k is preferably at most 90%, especially preferably at most 80%, of the dimension K.

The remaining wall thickness t, which results between adjacent recesses 2', 2", must also be mentioned. This is denoted in FIG. 2 at various points. If one determines an (arithmetic) mean value between the respective wall thicknesses t over a selected area (such as the area shown in FIG. 2), it is preferably intended that the wall thickness t remains essentially constant. Specifically, this can be quantified to the effect that the wall thickness t at any point of the selected area is not less than 80% and not more than 120% of the mean wall thickness t.

Through the proposed design, it can be achieved that the sole of the shoe has a special spring or cushioning behaviour, whereby, in particular when subjected to the weight of the wearer of the shoe, a predetermined collapse of the sole occurs as a result of the recesses, which provides a pleasant feeling of wear.

REFERENCE NUMERALS

1 Sole
2 Recess
2' Recess of the first group
2" Recess of the second group
3 Row of recesses
4 Row of recesses
5 Restriction
6 Outer sole
L Longitudinal direction
V Vertical direction
Q Transverse direction
R1 First direction
R2 Second direction
G Biggest dimension of the recess in the first direction
K Biggest dimension of the recess in the second direction
k Smallest extension
t Wall thickness

The invention claimed is:

1. A sole of a shoe, wherein the sole has a longitudinal extension in a longitudinal direction and a vertical extension in a vertical direction that is perpendicular to the longitudinal direction, wherein a plurality of recesses is provided in the sole that penetrate the sole at least in part, the plurality of recesses extending in a transverse direction that is perpendicular to the longitudinal direction and to the vertical direction, wherein, without external forces on the sole, a first group of recesses of the plurality of recesses are larger in the vertical direction than in the longitudinal direction and a second group of recesses of the plurality of recesses are smaller in the vertical direction than in the longitudinal direction, the recesses of the first and second groups of recesses having a peripheral contour forming a shape when viewed in the transverse direction, wherein, at least in sections, at least one row of the first and second groups of recesses is arranged adjacent to another row of the first and second groups of recesses in the longitudinal direction such that a recess of the second group is arranged between two recesses of the first group, wherein an upper row of recesses and a lower row of recesses are arranged above one another at least in sections in the vertical direction such that a recess of the first group lies vertically above a recess of the second group, and wherein, without external forces on the sole, a largest first dimension of a recess of the plurality of recesses in a first direction is at least 150% of a largest second dimension of the recess in a second direction that is perpendicular to the first direction such that, when an external force is applied to the sole, the plurality of recesses is configured to collapse.

2. The sole of claim 1, wherein the plurality of recesses penetrate the sole completely in the transverse direction.

3. The sole of claim 1, wherein the plurality of recesses extend along a straight line.

4. The sole of claim 1, wherein without external forces on the sole, the largest first dimension of a recess in the first direction is at least 180% of the largest second dimension of the recess in the second direction.

5. The sole of claim 1, wherein the plurality of recesses has, in a central region, a restriction with a minimum dimension which is at most 90% of the largest second dimension in the second direction.

6. The sole of claim 1, wherein the largest first dimension is between 8 millimeters and 18 millimeters, inclusive.

7. The sole of claim 1, wherein a wall thickness of a material of the sole remaining between the number of recesses is constant at least in sections.

8. The sole of claim 1, wherein the sole comprises a polyurethane material, thermoplastic polyurethane (TPU), or thermoplastic elastomer (TPE).

9. The sole of claim 8, wherein the sole comprises a material that is foamed.

10. The sole of claim 1, wherein the sole comprises a material having a density of between 0.20 g/cm$^3$ and 0.50 g/cm$^3$, inclusive.

11. The sole of claim 1, wherein the sole comprises a material having a hardness of between 30 Asker C and 50 Asker C, inclusive.

12. The sole of claim 1, wherein the sole is or comprises a midsole.

13. The sole of claim 12, wherein the midsole is connected to the upper and an outsole of the sole is arranged below the midsole.

14. The sole of claim 1, wherein the plurality of recesses is arranged in the longitudinal direction over at least 33% of a total distance taken along the longitudinal extension of the sole.

15. The sole of claim 1, wherein the plurality of recesses is arranged at least in a midfoot region and a rearfoot region of the sole.

16. The sole of claim 1, wherein the plurality of recesses of the sole are configured to collapse to produce a spring deflection when the external force is removed from the sole.

17. The sole of claim 1, wherein the shape is of a lemniscate.

18. A shoe, comprising:

an upper; and a sole structure connected to the upper, the sole structure comprising a midsole connected to the upper and an outsole arranged below the midsole, wherein the midsole includes a first row of recesses and a second row of recesses that extend through the midsole, the first row of recesses being disposed vertically above the second row of recesses such that the first row of recesses is closer to the upper than the outsole and the second row of recesses is closer to the outsole than the upper, wherein the first row of recesses and the second row of recesses include alternating vertical recesses and horizontal recesses, the vertical and horizontal recesses each having a peripheral contour, wherein the first row of recesses is arranged adjacent to the second row of recesses such that a horizontal recess of the second row of recesses is arranged below a vertical recess of the first row of recesses, wherein, without external forces on the sole structure, the vertical recesses are larger in a vertical direction of the sole structure than in the longitudinal direction and the horizontal recesses are smaller in the vertical direction than in the longitudinal direction, the vertical direction being perpendicular to the longitudinal direction, and wherein the first and second rows of recesses are configured to collapse when an external force is applied to the sole structure.

19. The shoe of claim 18, wherein the first row of recesses and the second row of recesses extend across a forefoot region, a midfoot region, and a rearfoot region of the sole structure.

20. The shoe of claim 18, wherein a central region of at least one of the vertical recesses has a restriction with a minimum dimension which is less than or equal to 90% of a largest horizontal dimension taken horizontally of the at least one of the vertical recesses.

21. The shoe of claim 18, wherein all of the vertical recesses and all of the horizontal recesses extend entirely through the midsole.

22. The shoe of claim 18, wherein the peripheral contour forms a shape of a lemniscate.

* * * * *